US011308917B2

(12) United States Patent
Okamoto et al.

(10) Patent No.: US 11,308,917 B2
(45) Date of Patent: Apr. 19, 2022

(54) DISPLAY DEVICE AND LIGHT INTENSITY CALCULATING METHOD

(71) Applicant: SHARP KABUSHIKI KAISHA, Sakai (JP)

(72) Inventors: Aya Okamoto, Sakai (JP); Naoko Goto, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/267,625

(22) PCT Filed: Aug. 14, 2019

(86) PCT No.: PCT/JP2019/031957
§ 371 (c)(1),
(2) Date: Feb. 10, 2021

(87) PCT Pub. No.: WO2020/040016
PCT Pub. Date: Feb. 27, 2020

(65) Prior Publication Data

US 2021/0311361 A1 Oct. 7, 2021

(30) Foreign Application Priority Data

Aug. 21, 2018 (JP) ..... JP2018-154909

(51) Int. Cl.
*G09G 5/10* (2006.01)
*G09G 3/34* (2006.01)

(52) U.S. Cl.
CPC ..... *G09G 5/10* (2013.01); *G09G 3/342* (2013.01); *G09G 2320/0285* (2013.01); *G09G 2320/0646* (2013.01); *G09G 2360/16* (2013.01)

(58) Field of Classification Search
CPC ... G09G 3/34–3426; G09G 3/36–3696; G09G 2320/029; G09G 2320/0626–0653; G09G 2360/16
See application file for complete search history.

(56) References Cited

U.S. PATENT DOCUMENTS

2005/0184952 A1* 8/2005 Konno ..... G09G 3/3648 345/102
2010/0309409 A1* 12/2010 Starkey ..... G09G 3/3413 349/62
2011/0043547 A1 2/2011 Nonaka et al.

FOREIGN PATENT DOCUMENTS

JP 2005258403 A 9/2005
WO 2010/131359 A1 11/2010

* cited by examiner

*Primary Examiner* — Patrick F Marinelli
(74) *Attorney, Agent, or Firm* — ScienBiziP, P.C.

(57) ABSTRACT

The amount of calculation related to correction of an image signal in a display device is suppressed. A liquid crystal display device includes a backlight luminance distribution calculation unit configured to calculate an intensity of illumination light from a backlight in a pixel of interest, and the backlight luminance distribution calculation unit calculates the intensity of illumination light with reference to a one-dimensional lookup table indicating a relationship between a distance from one of control areas included in the backlight to the pixel of interest and the intensity of illumination light at the distance.

8 Claims, 16 Drawing Sheets

DISPLAY DEVICE AND LIGHT INTENSITY CALCULATING METHOD

TECHNICAL FIELD

The present disclosure relates to a display device and a light intensity calculating method.

BACKGROUND ART

PTL 1 discloses an image display device including a light modulating element that forms an image in response to an image signal and a backlight that irradiates the light modulating element with illumination light. The image display device includes an illumination unit configured to divide illumination light into a plurality of regions and emit the divided illumination light, a luminance distribution calculating unit configured to calculate a luminance distribution of an image signal and determine brightness of the illumination light for each region, and an image correction unit configured to correct an image signal input to the light modulating element on the basis of the determination of the luminance distribution calculating unit. The image correction unit expresses a luminance distribution of backlight with an approximate function and corrects an image signal using the approximate function.

CITATION LIST

Patent Literature

PTL 1: JP 2005-258403 A

SUMMARY

Technical Problem

However, the amount of calculation increases in a case where correction is performed using an approximate function, and thus the cost of a circuit increases in order to obtain a sufficient processing speed.

An object of a display device according to an aspect of the present disclosure is to reduce the amount of calculation of the intensity of illumination light emitted from a backlight in a pixel of interest.

Solution to Problem

To solve the above-described problem, a display device according to an aspect of the present disclosure includes an illumination unit including a plurality of areas configured to emit light in response to light entering from a plurality of light sources configured to be independently controllable, a display unit including a plurality of pixels configured to receive illumination light from the illumination unit; and a calculation unit configured to calculate an intensity of the illumination light in a pixel of interest, wherein the illumination unit includes a light incident portion which is an end portion on which light from the plurality of light sources is incident and an opposing portion which is an end portion on a side opposite to the light incident portion and is divided along a first direction from the light incident portion to the opposing portion to form the plurality of areas, and the calculation unit calculates a virtual distance obtained by correcting a distance between the pixel of interest and one of the plurality of areas on the basis of a distance between the pixel of interest and the light incident portion and calculates an intensity of illumination light corresponding to the virtual distance that is calculated as an intensity of illumination light in the pixel of interest, with reference to a one-dimensional lookup table indicating a relationship between a distance from one of the plurality of areas and an intensity of illumination light at the distance.

In addition, a display device according to an aspect of the present disclosure includes an illumination unit including a plurality of areas configured to emit light in response to light entering from a plurality of light sources configured to be independently controllable, a display unit including a plurality of pixels configured to receive illumination light from the illumination unit, and a calculation unit configured to calculate an intensity of the illumination light in a pixel of interest with reference to a one-dimensional lookup table of the pixel of interest, the one-dimensional lookup table indicating a relationship between a distance from one of the plurality of areas and an intensity of illumination light at the distance, wherein the illumination unit includes a light incident portion which is an end portion on which light from the plurality of light sources is incident and an opposing portion which is an end portion on a side opposite to the light incident portion and is divided along a first direction from the light incident portion to the opposing portion to form the plurality of areas, and the calculation unit calculates an intensity of illumination light in the pixel of interest with reference to a first one-dimensional lookup table corresponding to a case where the pixel of interest is located at a first position in a first direction and a second one-dimensional lookup table corresponding to a case where the pixel of interest is located at a second position in the first direction.

In addition, a light intensity calculating method according to an aspect of the present disclosure is a light intensity calculating method for calculating an intensity of illumination light from an illumination unit in a pixel of interest of a display device, the display device including an illumination unit including a plurality of areas configured to emit light in response to light entering from a plurality of light sources configured to be independently controllable and a display unit including a plurality of pixels configured to receive illumination light from the illumination unit, the illumination unit including a light incident portion which is an end portion on which light from the plurality of light sources is incident and an opposing portion which is an end portion on a side opposite to the light incident portion and being divided along a first direction from the light incident portion to the opposing portion to form the plurality of areas, the light intensity calculating method including calculating a virtual distance obtained by correcting a distance between the pixel of interest and one of the plurality of areas on the basis of a distance between the pixel of interest and the light incident portion, and calculating an intensity of illumination light in the pixel of interest with reference to a one-dimensional lookup table indicating a relationship between a distance from the area and an intensity of illumination light at the distance by using the virtual distance that is calculated.

In addition, a light intensity calculating method according to an aspect of the present disclosure is a light intensity calculating method for calculating an intensity of illumination light from an illumination unit in a pixel of interest of a display device, the display device including the illumination unit including a plurality of areas configured to emit light in response to light entering from a plurality of light sources configured to be independently controllable and a display unit including a plurality of pixels configured to receive illumination light from the illumination unit, the illumination unit including a light incident portion which is an end portion on which light from the plurality of light sources is incident and an opposing portion which is an end portion on a side opposite to the light incident portion and being divided along a first direction from the light incident portion to the opposing portion to form the plurality of areas, the light intensity calculating method including calculating a first illumination light intensity corresponding to a distance from one of the plurality of areas with reference to a first one-dimensional lookup table of the pixel of interest which indicates a relationship between the distance and an intensity of illumination light at the distance, the first one-dimensional lookup table corresponding to a case where the pixel of interest is located at a first position in the first direction, calculating a second illumination light intensity corresponding to the distance with reference to a second one-dimensional lookup table which is the one-dimensional lookup table and corresponds to a case where the pixel of interest is located at a second position in the first direction, and calculating an intensity of illumination light in the pixel of interest by using the first and second illumination light intensities that are calculated.

Advantageous Effects of Disclosure

According to a display device and a light intensity calculating method according to an aspect of the present disclosure, the amount of calculation of the intensity of illumination light emitted from a backlight in a pixel of interest can be reduced.

DESCRIPTION OF EMBODIMENTS

First Embodiment

Hereinafter, an embodiment of the present disclosure will be described in detail. In the present embodiment, a liquid crystal display device will be described as an example of a display device according to an aspect of the present disclosure. However, the display device according to the aspect of the present disclosure may be a display device of a different type from a liquid crystal display device. That is, a display unit included in the display device according to the aspect of the present disclosure may include a display panel that operates according to a mechanism different from that of a liquid crystal panel, instead of a liquid crystal panel. Specifically, the display device according to the aspect of the present disclosure may be, for example, an electrochromic display device, an electrophoretic display device, a toner display device, a lead lanthanum zirconate titanate (PLZT) display device, or the like.

Further, in the present embodiment, a display device including a backlight as an illumination unit will be described as an example of the display device according to the aspect of the present disclosure. However, the display device according to the aspect of the present disclosure may be a display device including an illumination unit different from the backlight, such as a front light.

Figure 1:
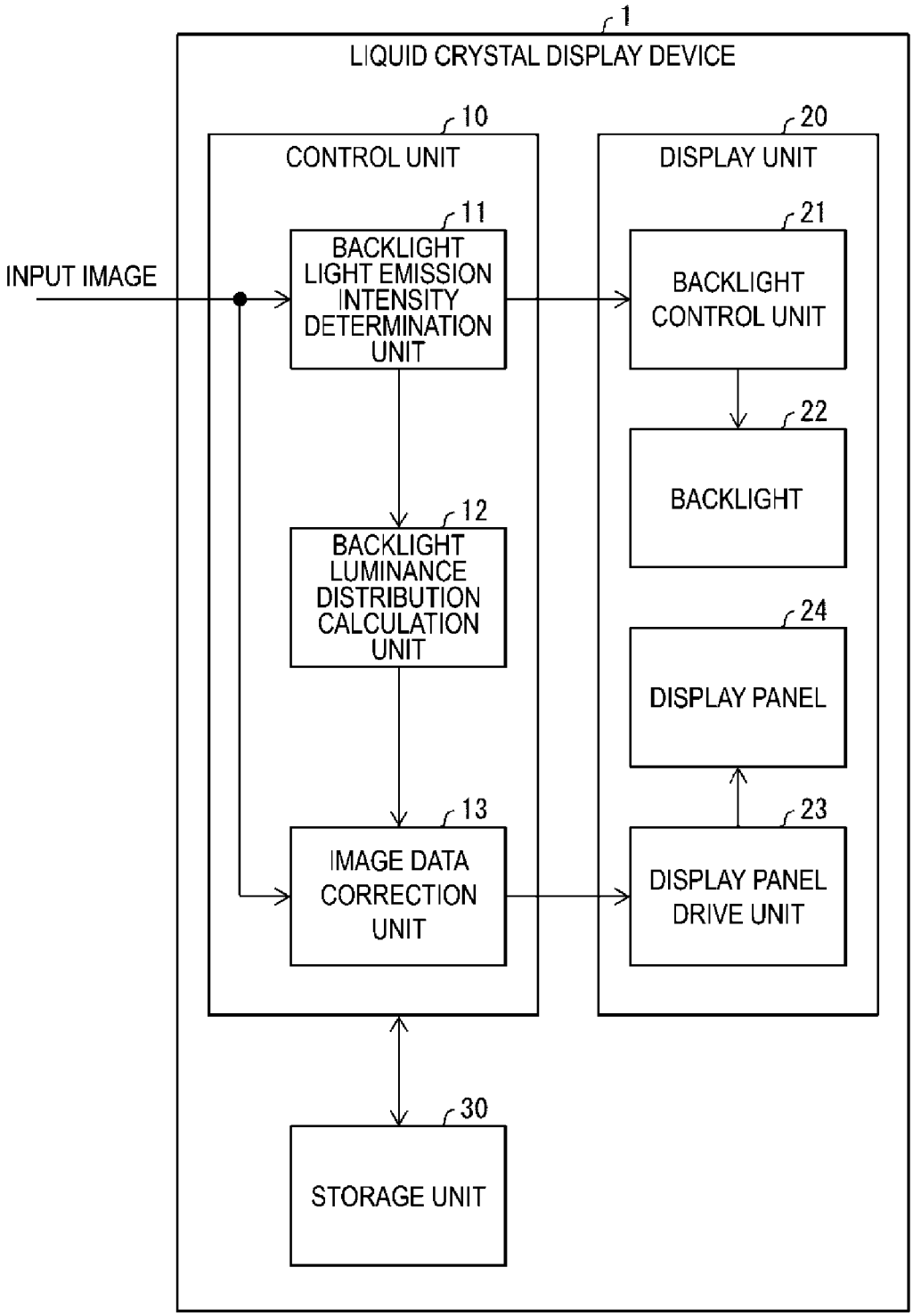
FIG. 1 is a block diagram illustrating a configuration of a liquid crystal display device according to a first embodiment.

FIG. 1 is a block diagram illustrating a configuration of a liquid crystal display device (display device) 1 according to the present embodiment. As illustrated in FIG. 1, the liquid crystal display device 1 includes a control unit 10, a display unit 20, and a storage unit 30.

The control unit 10 performs processing related to the image display performed on the liquid crystal display device 1. A specific configuration of the control unit 10 will be described later.

The display unit 20 displays an image processed by the control unit 10. The display unit 20 includes a backlight control unit 21, a backlight (illumination unit) 22, a display panel drive unit 23, and a display panel 24 (display unit).

Figure 2:
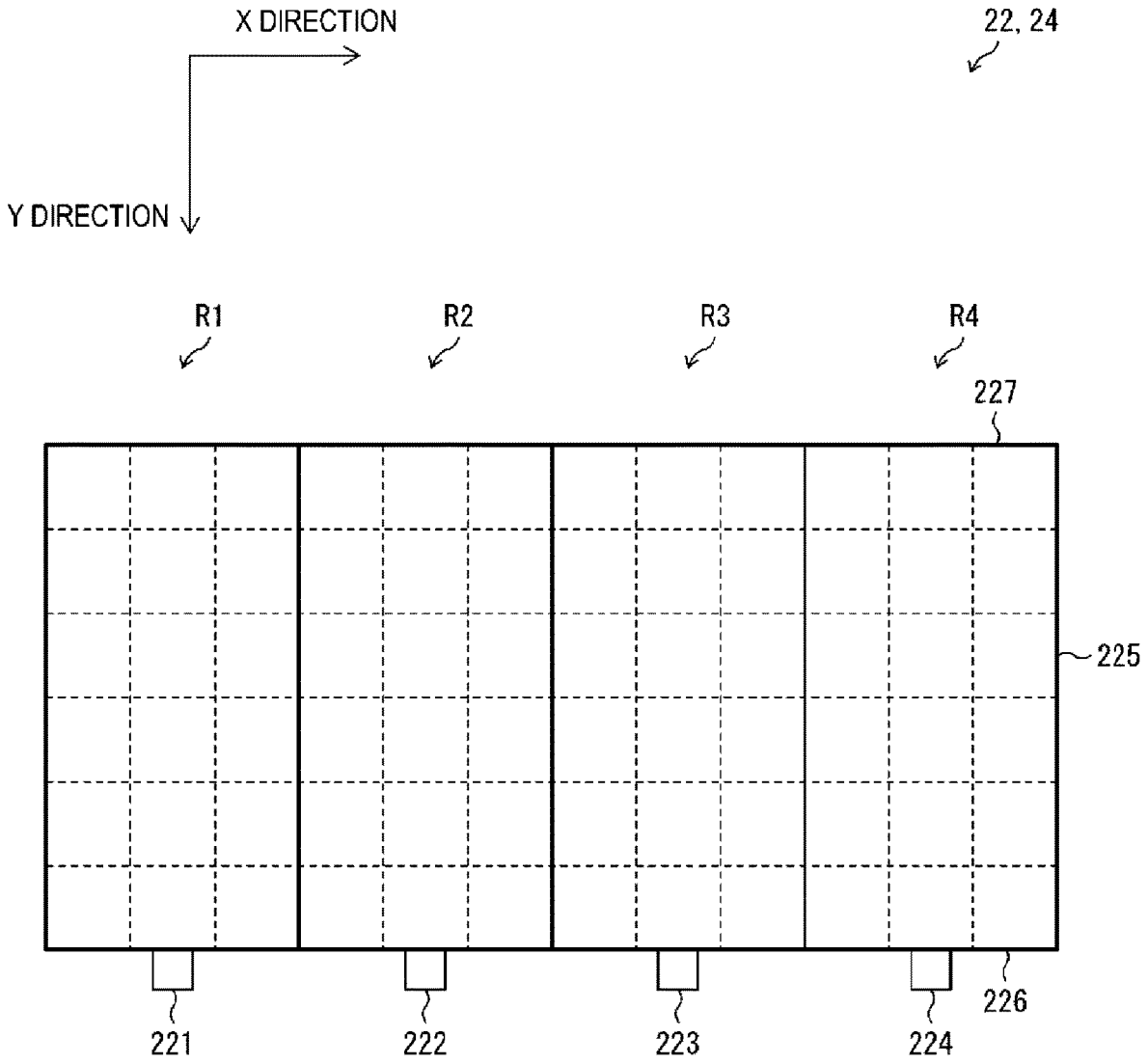
FIG. 2 is a plan view illustrating a configuration of a backlight and a display panel.

FIG. 2 is a plan view illustrating configurations of the backlight 22 and the display panel 24. The backlight 22 includes a plurality of light sources 221, 222, 223 and 224 that can be controlled independently and a light guide plate 225. The light sources 221 to 224 may be a light-emitting element such as a light emitting diode (LED). Each of the light sources 221 to 224 may be a single light-emitting element, or may be a set of a plurality of light-emitting elements.

The light guide plate 225 includes a light incident portion 226 on which light from the light sources 221 to 224 is incident, and an opposing portion 227 which is an end portion on a side opposite to the light incident portion 226. The backlight 22 has control areas R1, R2, R3, and R4 (areas) that are formed by dividing the backlight 22 in a direction from the light incident portion 226 to the opposing portion 227 (first direction). In a case where light from the plurality of light sources 221 to 224 that can be controlled independently are incident on the control areas R1 to R4, the control areas R1 to R4 emit light. In other words, the control areas R1 to R4 are areas corresponding to the smallest unit where the light-emitting elements serving as the light sources 221 to 224 can be individually driven. In FIG. 2, the control areas R1 to R4 are separated by solid lines.

In the drawings, a direction from the opposing portion 227 to the light incident portion 226 is indicated as a +y direction. Further, in the drawings, a direction from the control area R1 to the control area R4 is indicated as a +x direction. The x direction is perpendicular to the y direction.

The display panel 24 is a liquid crystal panel including a plurality of pixels that receive illumination light from the backlight 22. In FIG. 2, the plurality of pixels are separated by dashed lines.

Note that the configurations of the backlight 22 and the display panel 24 illustrated in FIG. 2 are simplified for the sake of description, and the number of control areas, the number of light sources, the number of pixels, and the like are not limited to the example illustrated in FIG. 2.

The backlight control unit 21 controls the backlight 22 on the basis of data indicating light emission intensities of the control areas R1 to R4 which are input from a backlight light emission intensity determination unit 11 to be described later. The display panel drive unit 23 drives the display panel 24 on the basis of corrected image data which is input from an image data correction unit 13 to be described later.

The storage unit 30 stores information necessary for processing performed by the control unit 10. However, the liquid crystal display device 1 needs not include the storage unit 30, and may be communicably connected to a storage device provided outside the liquid crystal display device 1.

A specific configuration of the control unit 10 will be described. As illustrated in FIG. 1, the control unit 10 includes a backlight light emission intensity determination unit 11, a backlight luminance distribution calculation unit 12 (calculation unit), and an image data correction unit 13.

The backlight light emission intensity determination unit 11 determines light emission intensities of the control areas R1 to R4 of the backlight 22. More specifically, the backlight light emission intensity determination unit 11 calculates a maximum value or an average value of pixel values of pixels included in partial regions of an input image corresponding to the respective control areas R1 to R4 of the backlight 22. Furthermore, the backlight light emission intensity determination unit 11 determines light emission intensities of the light sources 221 to 224 that cause light to be incident on the respective control areas R1 to R4 on the basis of the calculated maximum value or average value of the pixel values. In addition, the backlight light emission intensity determination unit 11 outputs data indicating the determined light emission intensities of the control areas R1 to R4 to the backlight control unit 21 and the backlight luminance distribution calculation unit 12.

The backlight luminance distribution calculation unit 12 calculates the intensity of illumination light in the display panel 24 on the basis of the light emission intensities of the control areas R1 to R4 which are input from the backlight light emission intensity determination unit 11. Specifically, the backlight luminance distribution calculation unit 12 sets one of the plurality of pixels of the display panel 24 to a pixel of interest and calculates a distance between the pixel of interest and the control area R1. Furthermore, the backlight luminance distribution calculation unit 12 calculates a virtual distance obtained by correcting the distance between a pixel of interest and the control area R1 on the basis of a distance between the pixel of interest and the light incident portion 226 and calculates the intensity of illumination light corresponding to the calculated virtual distance with reference to an LUT (one-dimensional lookup table). The LUT is a table indicating a relationship between a distance from one of the plurality of control areas and the intensity of illumination light at the distance.

The backlight luminance distribution calculation unit 12 also calculates the intensity of illumination light emitted to the pixel of interest from the other control areas R2 to R4 similarly to the control area R1, and integrates the calculated four intensities. The backlight luminance distribution calculation unit 12 outputs the integrated value to the image data correction unit 13 as the intensity of illumination light in the pixel of interest. The backlight luminance distribution calculation unit 12 performs such processing on all of the plurality of pixels of the display panel 24.

Note that, in a case where the pixel of interest and the control area are separated from each other by a predetermined distance or more, such a control area may be removed from an object to be processed by the backlight luminance distribution calculation unit 12. That is, the backlight luminance distribution calculation unit 12 may calculate the intensity of illumination light emitted to the pixel of interest by at least one of the plurality of control areas.

The image data correction unit 13 corrects gray scale values of pixels of an input image on the basis of the intensity of illumination light. For example, when the intensity of a backlight is half that during full lighting in a certain pixel, the image data correction unit 13 corrects the gray scale value of the pixel to twice the gray scale value in the input image. The image data correction unit 13 outputs the corrected image data to the display panel drive unit 23.

Processing in Liquid Crystal Display Device 1

Figure 3:
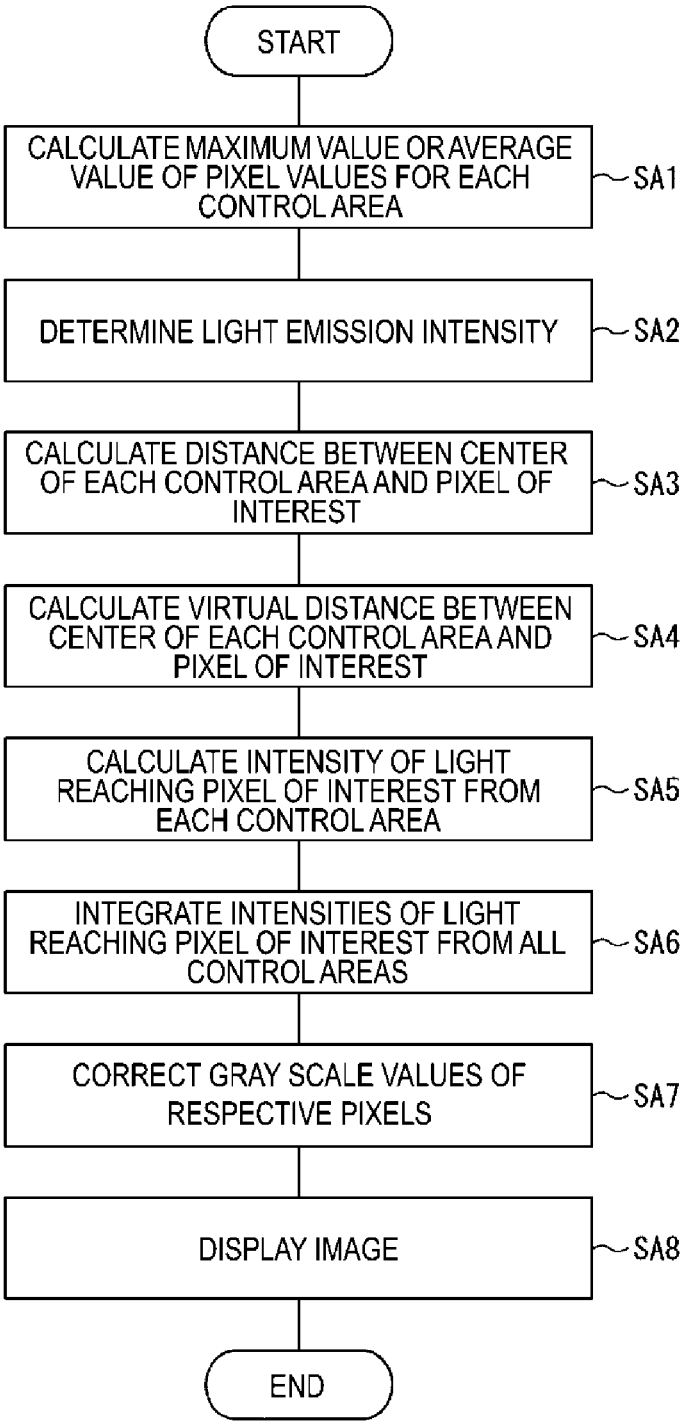
FIG. 3 is a flowchart illustrating an example of a flow of processing in the liquid crystal display device according to the first embodiment.

FIG. 3 is a flowchart illustrating an example of a flow of processing in the liquid crystal display device 1 according to the present embodiment. The processing in the liquid crystal display device 1 according to the present embodiment will be described with reference to FIG. 3. The processing includes a light intensity calculating method for calculating the intensity of illumination light emitted from the backlight 22 in a pixel of interest of the liquid crystal display device 1 which is performed by the backlight luminance distribution calculation unit 12.

When an input image is input to the liquid crystal display device 1, the backlight light emission intensity determination unit 11 first calculates a maximum value or an average value of pixel values of pixels included in a corresponding partial region of the input image for each control area (SA1). Next, the backlight light emission intensity determination unit 11 determines light emission intensities of the control areas R1 to R4 of the backlight 22 on the basis of the derived maximum value or average value of the pixel values for each partial region (SA2).

The backlight luminance distribution calculation unit 12 calculates a distance between a central area of each of the control areas R1 to R4 and a pixel of interest (SA3). Next, the backlight luminance distribution calculation unit 12 multiplies the distance calculated in step SA3 by a predetermined coefficient to calculate a virtual distance obtained by correcting a distance between the pixel of interest and each of the control areas R1 to R4 on the basis of a distance between the pixel of interest and the light incident portion 226 (SA4). Furthermore, the backlight luminance distribution calculation unit 12 calculates the intensity of illumination light in a pixel of interest with reference to an LUT indicating a relationship between a distance from one of the control areas R1 to R4 and the intensity of illumination light at the distance by using the calculated virtual distance (SA5).

Subsequently, the backlight luminance distribution calculation unit 12 calculates the intensity of illumination light emitted from the backlight 22 in the pixel of interest by integrating the intensities of illumination light reaching the pixel of interest from all of the control areas R1 to R4 (SA6). The backlight luminance distribution calculation unit 12 performs processing of steps SA3 to SA6 on all pixels of the display panel 24.

After the intensity of illumination light emitted from the backlight 22 is calculated for all pixels of the display panel 24, the image data correction unit 13 corrects gray scale values of the pixels in the input image (SA7). Thereafter, the backlight control unit 21 controls the backlight 22 using the light emission intensities of the control areas R1 to R4 determined in step SA2 and the gray scale values of the pixels of the image which are corrected in step SA7, and the display panel drive unit 23 drives the display panel 24, whereby the liquid crystal display device 1 displays an image (SA8).

Specific Example

Figure 4:
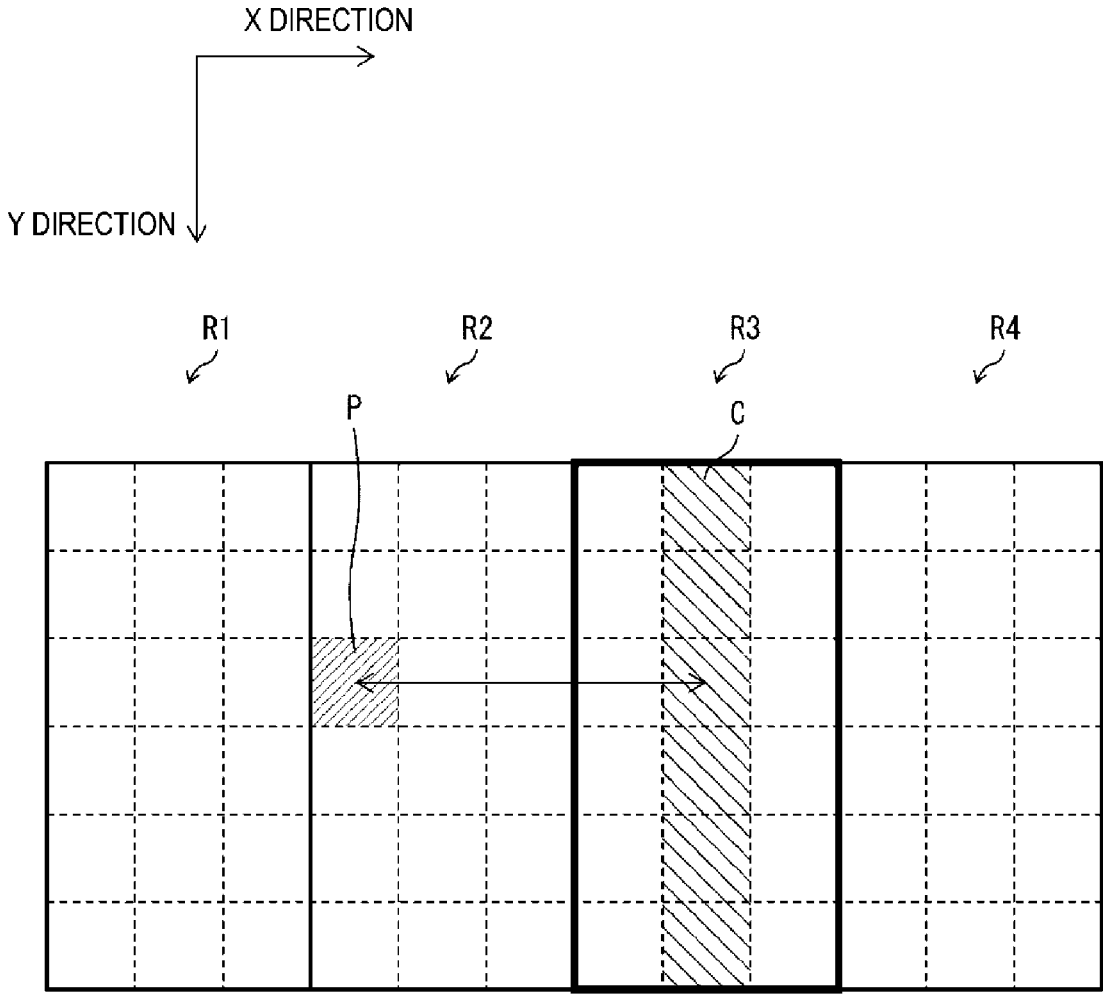
FIG. 4 is a diagram illustrating one pixel of interest and a central area of one control area.

FIG. 4 is a diagram illustrating one pixel of interest P and a central area C of one control area R3. Referring to FIG. 4, a specific example of processing of the above-described steps SA3 to SA5 in one pixel of interest P will be described.

As illustrated in FIG. 4, the pixel of interest P is located at a distance of 4 in the x direction from the central area C located at the center of the control area R3. In addition, the pixel of interest P is located at a distance of 3 in the y direction from the opposing portion 227.

First, the backlight luminance distribution calculation unit 12 calculates that the distance between the pixel of interest P and the central area C is 4 (SA3). Next, the backlight luminance distribution calculation unit 12 calculates a virtual distance on the basis of the calculated distance (SA4).

Figure 5:
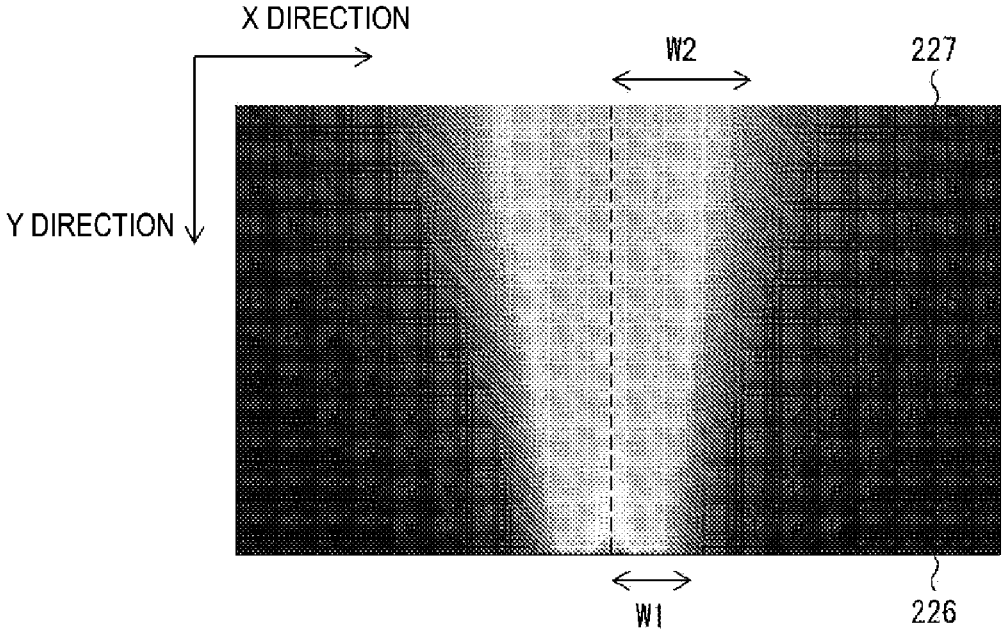
FIG. 5 is a diagram illustrating an intensity distribution of illumination light emitted from one light source in a light guide plate.

FIG. 5 is a diagram illustrating an intensity distribution of illumination light emitted from any one of the light sources 221 to 224 in the light guide plate 225. As illustrated in FIG. 5, in a case where a width in which light emitted from any one of the light sources 221 to 224 has an intensity equal to or greater than a predetermined intensity at the light incident portion 226 is denoted by W1 and a width in which the light has an intensity equal to or greater than a predetermined intensity at the opposing portion 227 is denoted by W2, a relationship of W1<W2 is satisfied. For this reason, in the backlight 22, a phenomenon in which the intensity of light decreases as a pixel is positioned closer to the light incident portion 226 occurs.

Consequently, the backlight luminance distribution calculation unit 12 calculates a virtual distance using an equation in which the virtual distance increases as a distance from the light incident portion 226 decreases (SA5). The backlight luminance distribution calculation unit 12 calculates the virtual distance, for example, according to Equation (1) below.

$$D2=(1+c\times(n-1))\times D1 \quad (1)$$

D1: Distance

D2: Virtual distance c: Coefficient n: The number of rows of the pixel of interest viewed from the opposing portion 227

The value of the coefficient c may be appropriately set so that a calculation result of a light intensity based on a virtual distance approaches an actual measurement value. For example, in a case where c=0.01, a virtual distance D2 between the pixel of interest P illustrated in FIG. 4 and the control area R3 is obtained as follows:

$$D2=(1+0.01\times 2)\times 4=4.08.$$

Note that the value of the coefficient c may be a value different from 0.01. Furthermore, the value of the coefficient c does not need to be constant, and for example, may be different for each row in the y direction. In this case, the coefficient for each row in the y direction may be stored in the storage unit 30 as an LUT different from the LUT referred to in step SA5.

Figure 6:
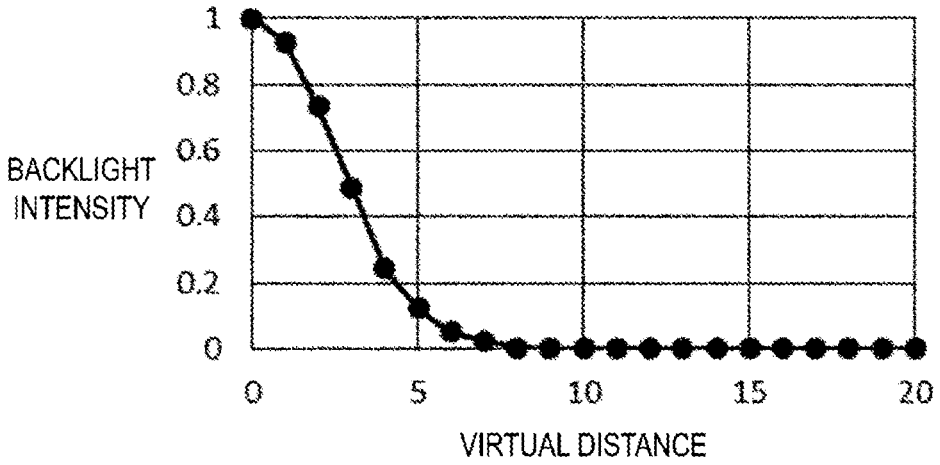
FIG. 6 is a graph showing an example of an LUT in the first embodiment.

FIG. 6 is a graph showing an example of the LUT in the present embodiment. In FIG. 6, the horizontal axis represents a virtual distance, and the vertical axis represents a value obtained by normalizing the intensity of illumination light by setting an upper limit value to 1. The LUT shown in FIG. 6 is data indicating the intensity of illumination light for each pixel and created on the basis of an actual measurement value of luminance of the light incident portion 226. The backlight luminance distribution calculation unit 12 calculates the intensity of light in each pixel by performing linear interpolation between adjacent data points illustrated in FIG. 6 (SA5).

As described above, the virtual distance of the pixel of interest P from the control area R3 is 4.08. The backlight luminance distribution calculation unit 12 performs linear interpolation between a data point in a case where the virtual distance is 4 and a data point in a case where the virtual distance is 5 to calculate the intensity of light in a case where the virtual distance is 4.08.

Note that, in an aspect of the present disclosure, the LUT used in step SA5 may be created on the basis of the actual measurement value of luminance in the opposing portion 227 instead of the light incident portion 226. The LUT used in step SA5 may be data indicating the intensity of illumination light for each freely-selected number of pixels within a range of approximately one pixel to 100 pixels. In addition, interpolation between data points may be, for example, spline interpolation or the like, in addition to linear interpolation.

Figure 7:
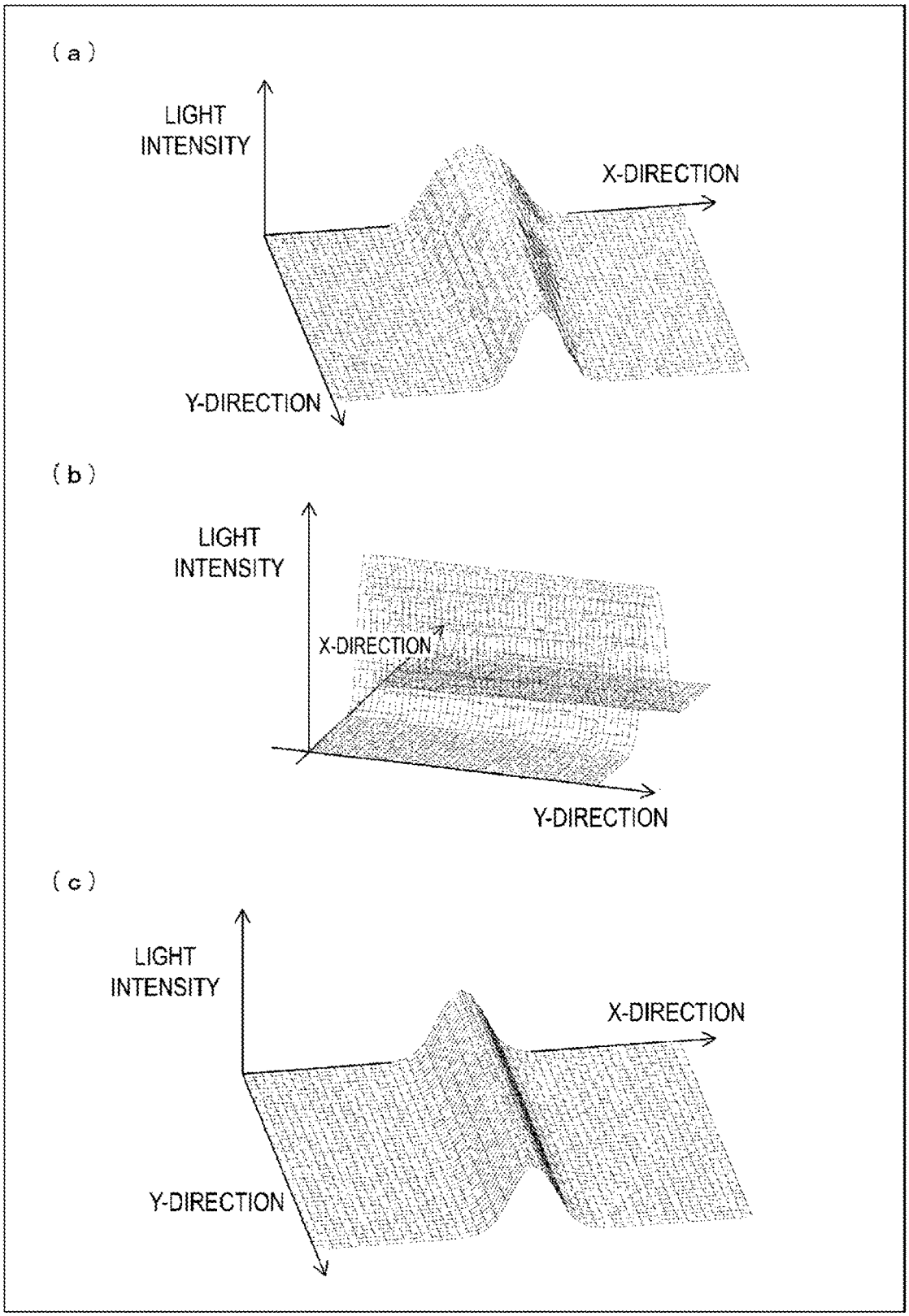
FIGS. 7(*a*) and 7(*b*) are graphs showing an intensity distribution of illumination light emitted from a light source, the intensity distribution being calculated by a backlight luminance distribution calculation unit, and FIG. 7(*c*) is a graph showing an intensity distribution of light emitted by a light source, the intensity distribution being calculated in a case where the backlight luminance distribution calculation unit does not execute calculation.

(a) and (b) of FIG. 7 are graphs showing an intensity distribution of illumination light from the light source 221 which is calculated by the backlight luminance distribution calculation unit 12. Although scales differ between (a) and (b) of FIG. 7 for ease of viewing, these are the same graph viewed from different angles. (c) of FIG. 7 is a graph showing an intensity distribution of light emitted by the light source 221, the intensity distribution being calculated in a case where the backlight luminance distribution calculation unit 12 does not execute calculation. Comparing (a) and (b) of FIG. 7 with (c) of FIG. 7, it can be understood that the backlight luminance distribution calculation unit 12 can reproduce spreading of illumination light according to a distance between the light incident portion 226 and a pixel of interest in the y-direction by executing step SA4, that is, by calculating a virtual distance and calculating the intensity of the illumination light on the basis of the virtual distance.

Modified Example

In an aspect of the present disclosure, the backlight luminance distribution calculation unit 12 may perform calculation for reproducing not only the spreading of illumination light according to a distance in the y direction, but also the attenuation of an illumination light intensity. Specifically, the backlight luminance distribution calculation unit 12 may perform correction on the intensity of light reaching a pixel of interest from each control area which is calculated in step SA5 illustrated in FIG. 3, in accordance with a distance in the y direction between the light incident portion 226 and the pixel of interest.

For example, the intensity of illumination light at the light incident portion 226 is set to 1, the intensity of illumination light at the opposing portion 227 is set to a, and it is assumed that the intensity of illumination light attenuates linearly from the light incident portion 226 to the opposing portion 227. In this case, the backlight luminance distribution calculation unit 12 may correct the intensity of illumination light in the pixel of interest P according to Equation (2) below.

$$IA2=IA1\times(((1-\alpha)/IMG_Y)\times n+\alpha) \quad (2)$$

IA2: Illumination light intensity after correction in the pixel of interest P

IA1: Illumination light intensity before correction in the pixel of interest P

IMG_Y: An image size in the y direction n: The number of rows of the pixel of interest viewed from the opposing portion 227

Thereafter, the backlight luminance distribution calculation unit 12 performs the process of step SA6 and the subsequent processes illustrated in FIG. 3 by using the corrected illumination light intensity.

Figure 8:
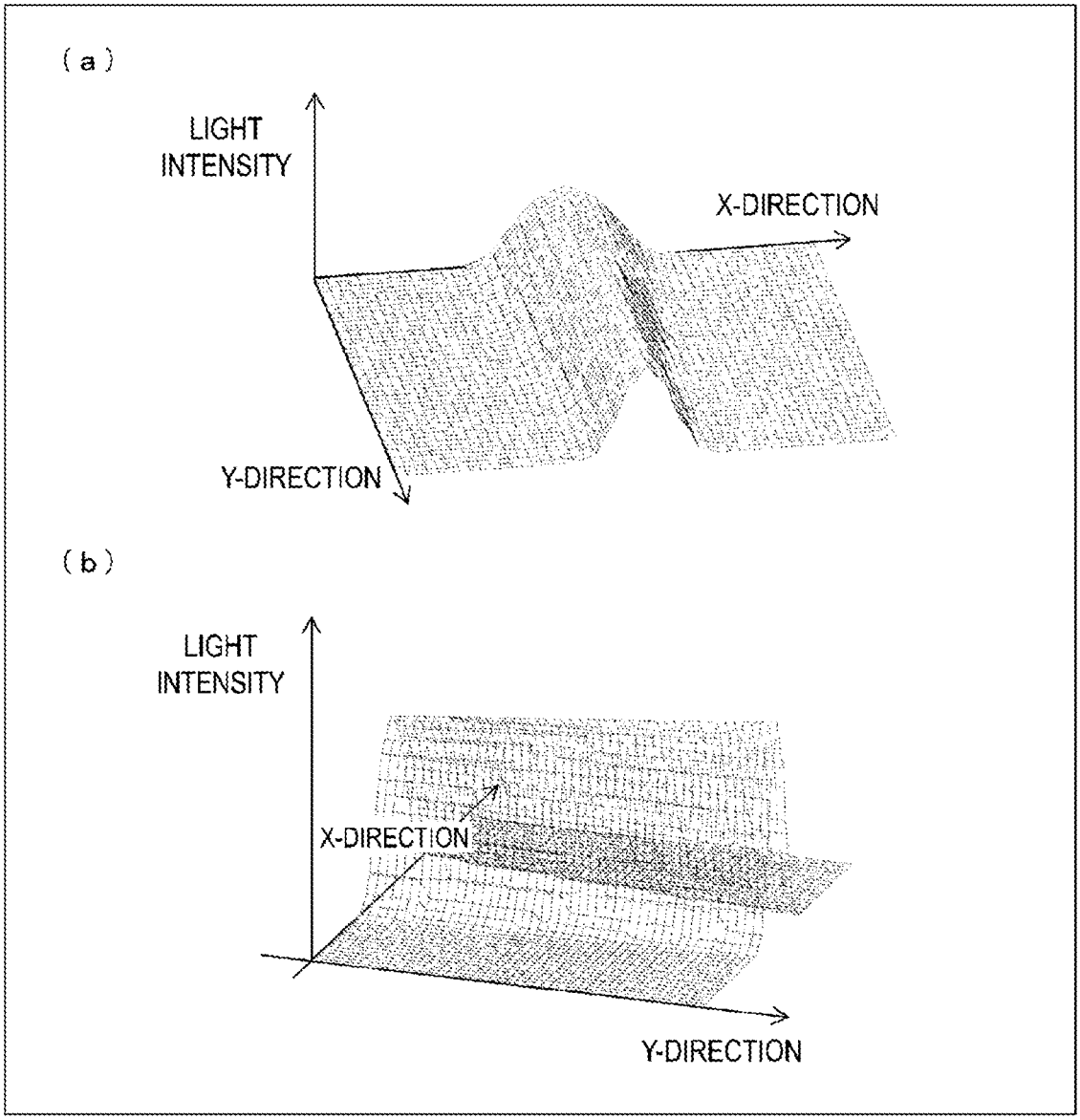
FIGS. 8(*a*) and 8(*b*) are diagrams illustrating examples of an illumination light intensity calculated by a backlight luminance distribution calculation unit according to a modified example of the first embodiment.

(a) and (b) of FIG. 8 are diagrams illustrating an example of an illumination light intensity calculated by the backlight luminance distribution calculation unit 12 according to the present modified example. Although scales differ between (a) and (b) of FIG. 8 for ease of viewing, these are the same graph viewed from different angles. Comparing (a) and (b) of FIG. 8 with (a) and (b) of FIG. 7, it can be understood that the backlight luminance distribution calculation unit 12 according to the present modified example can reproduce attenuation of an illumination light intensity according to a distance.

Second Embodiment

Another embodiment of the present disclosure will be described below. Note that, for convenience of description, members having the same functions as those of the members described in the above-described embodiment will be denoted by the same reference numerals and signs, and the description thereof will not be repeated. A liquid crystal display device according to the present embodiment has the same configuration as that of the liquid crystal display device according to the first embodiment. Accordingly, in the following description, the liquid crystal display device according to the present embodiment is also referred to as the liquid crystal display device 1.

In the present embodiment, the backlight luminance distribution calculation unit 12 calculates the intensity of illumination light in a pixel of interest with reference to a first LUT (first one-dimensional lookup table) corresponding to a case where the pixel of interest is located at a first position in the y direction and a second LUT (second one-dimensional lookup table) corresponding to a case where the pixel of interest is located at a second position in a first direction. Specifically, the backlight luminance distribution calculation unit 12 calculates (i) a first illumination light intensity corresponding to a distance between each of control areas R1 to R4 and the pixel of interest which is determined with reference to the first LUT and (ii) a second illumination light intensity corresponding to a distance between each of the control areas R1 to R4 and the pixel of interest which is determined with reference to the second LUT, and calculates the intensity of illumination light in the pixel of interest on the basis of at least the first illumination light intensity, the second illumination light intensity, and the relative position of the pixel of interest in the first direction. Similarly to the backlight luminance distribution calculation unit 12 in the first embodiment, the backlight luminance distribution calculation unit 12 can calculate the intensity of illumination light in the pixel of interest.

In the present embodiment, the first position is the position of a pixel closest to the light incident portion 226 among a plurality of pixels of the display panel 24 corresponding to a control area of interest. In addition, the second position is the position of a pixel closest to the opposing portion 227 among the plurality of pixels of the display panel 24 corresponding to a control area of interest. In other words, the first LUT corresponds to a case where the pixel of interest is located closest to the light incident portion 226. Furthermore, the second LUT corresponds to a case where the pixel of interest is located closest to the opposing portion 227. Thus, the intensity of illumination light for the pixel of interest at any location can be calculated by performing interpolation between the first illumination light intensity and the second illumination light intensity.

However, the first position may be a position different from the position closest to the light incident portion 226. In this case, the position of the pixel of interest may be closer to the light incident portion 226 than the first position. In this case, the backlight luminance distribution calculation unit 12 can calculate the intensity of illumination light in the pixel of interest by extending a straight line or a curved line obtained by performing interpolation between the first illumination light intensity and the second illumination light intensity to the position of the pixel of interest. The second position may be a position different from the position closest to the opposing portion 227. In this case, also when the position of the pixel of interest is located closer to the opposing portion 227 than the second position, a method similar to the calculation method for the first position described above can be used.

Figure 9:
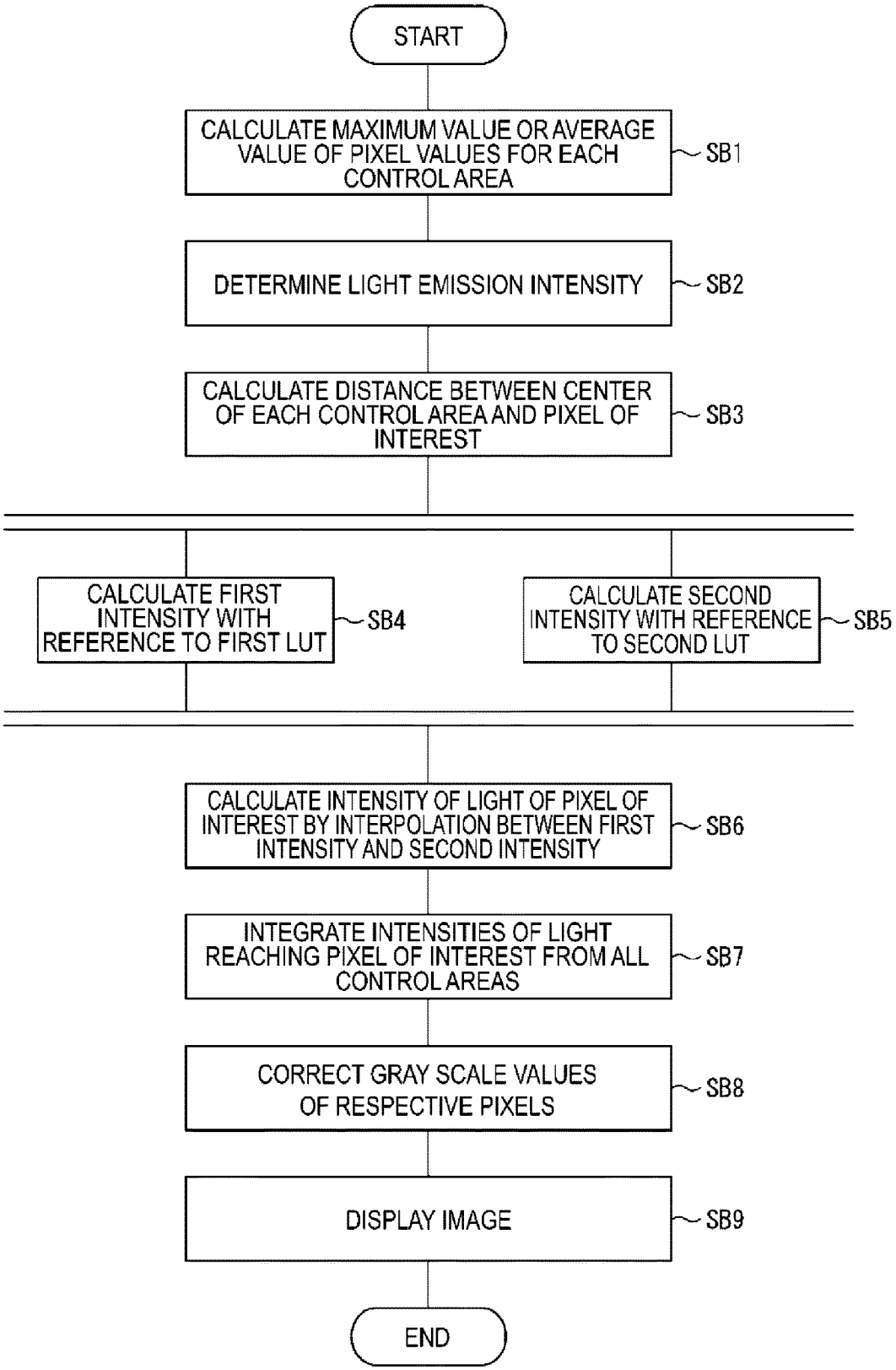
FIG. 9 is a flowchart illustrating an example of a flow of processing in a liquid crystal display device according to a second embodiment.

FIG. 9 is a flowchart illustrating an example of a flow of processing in the liquid crystal display device 1 according to the present embodiment. The processing in the liquid crystal display device 1 according to the present embodiment will be described with reference to FIG. 9. The processing includes a light intensity calculating method for calculating the intensity of illumination light emitted from the backlight 22 in a pixel of interest of the liquid crystal display device 1 which is performed by the backlight luminance distribution calculation unit 12.

The processes of steps SB1 to SB3 are the same as the above-described processes of steps SA1 to SA3, respectively. After step SB3 is performed, the backlight luminance distribution calculation unit 12 calculates the first illumination light intensity with reference to the first LUT (SB4). In addition, the backlight luminance distribution calculation unit 12 calculates the second illumination light intensity with reference to the second LUT (SB5). Here, steps SB4 and SB5 may be executed simultaneously as illustrated in FIG. 9, or may be executed in any order.

The backlight luminance distribution calculation unit 12 calculates the intensity of light in the pixel of interest by using the first illumination light intensity and the second illumination light intensity (SB6). Details of this processing will be described later. Thereafter, the liquid crystal display device 1 displays an image through the processes of steps SB7 to SB9. The processes of steps SB7 to SB9 are the same as the above-described processes of steps SA6 to SA8, respectively.

Specific Example

Figure 10:
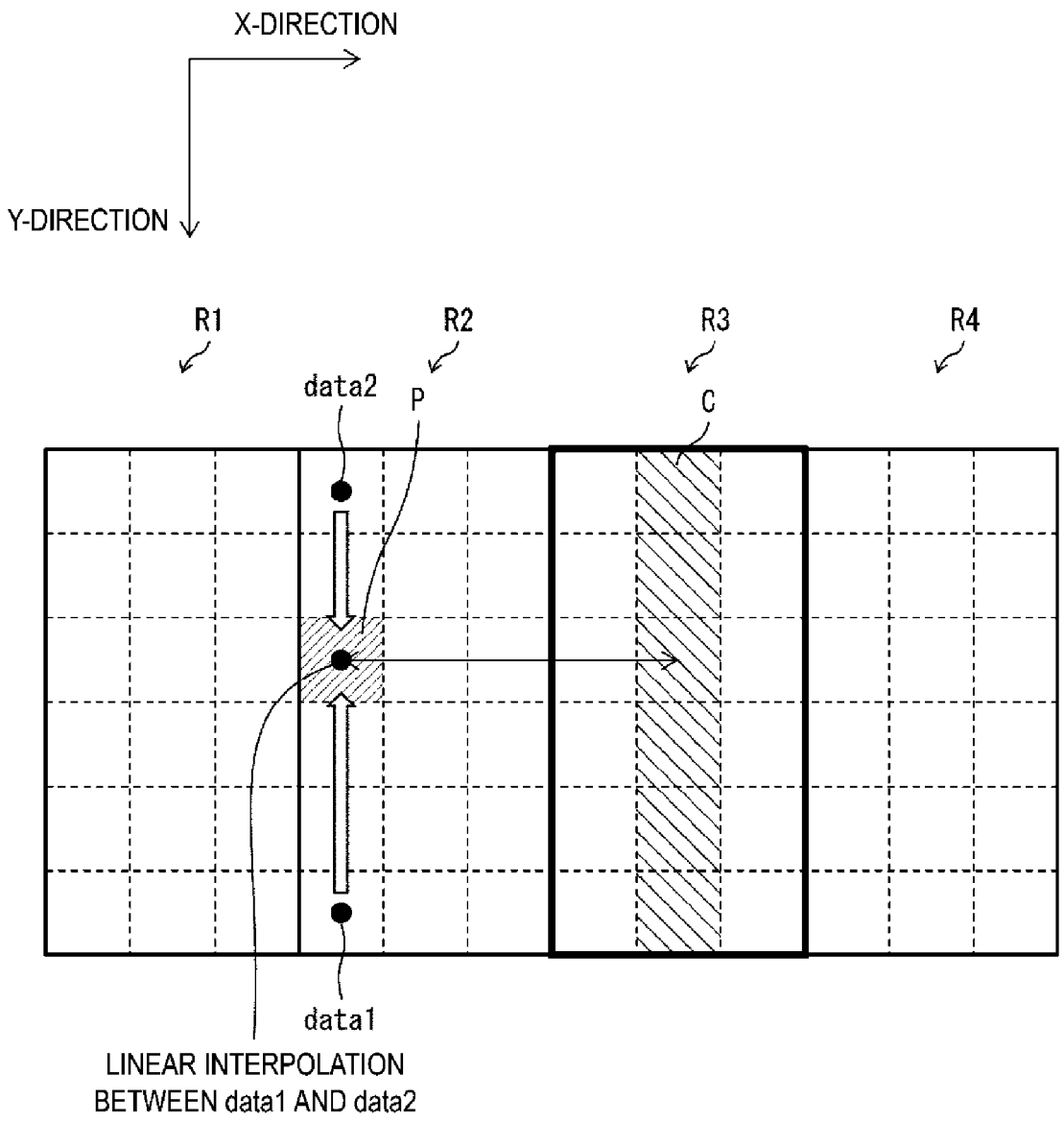
FIG. 10 is a diagram schematically illustrating processing in the liquid crystal display device according to the second embodiment.

FIG. 10 is a diagram schematically illustrating processing in the liquid crystal display device 1 according to the present embodiment. Referring to FIG. 10, a specific example of the above-described processes of steps SB3 to SB6 in one pixel of interest P will be described. The position of the pixel of interest Pin FIG. 10 is the same as the position of the pixel of interest Pin FIG. 4.

First, the backlight luminance distribution calculation unit 12 calculates that a distance between the pixel of interest P and a central area C of a control area R3 is 4 (SB3). Next, the backlight luminance distribution calculation unit 12 calculates data1 indicating the first illumination light intensity and data2 indicating the second illumination light intensity (SB4, SB5).

Figure 11:
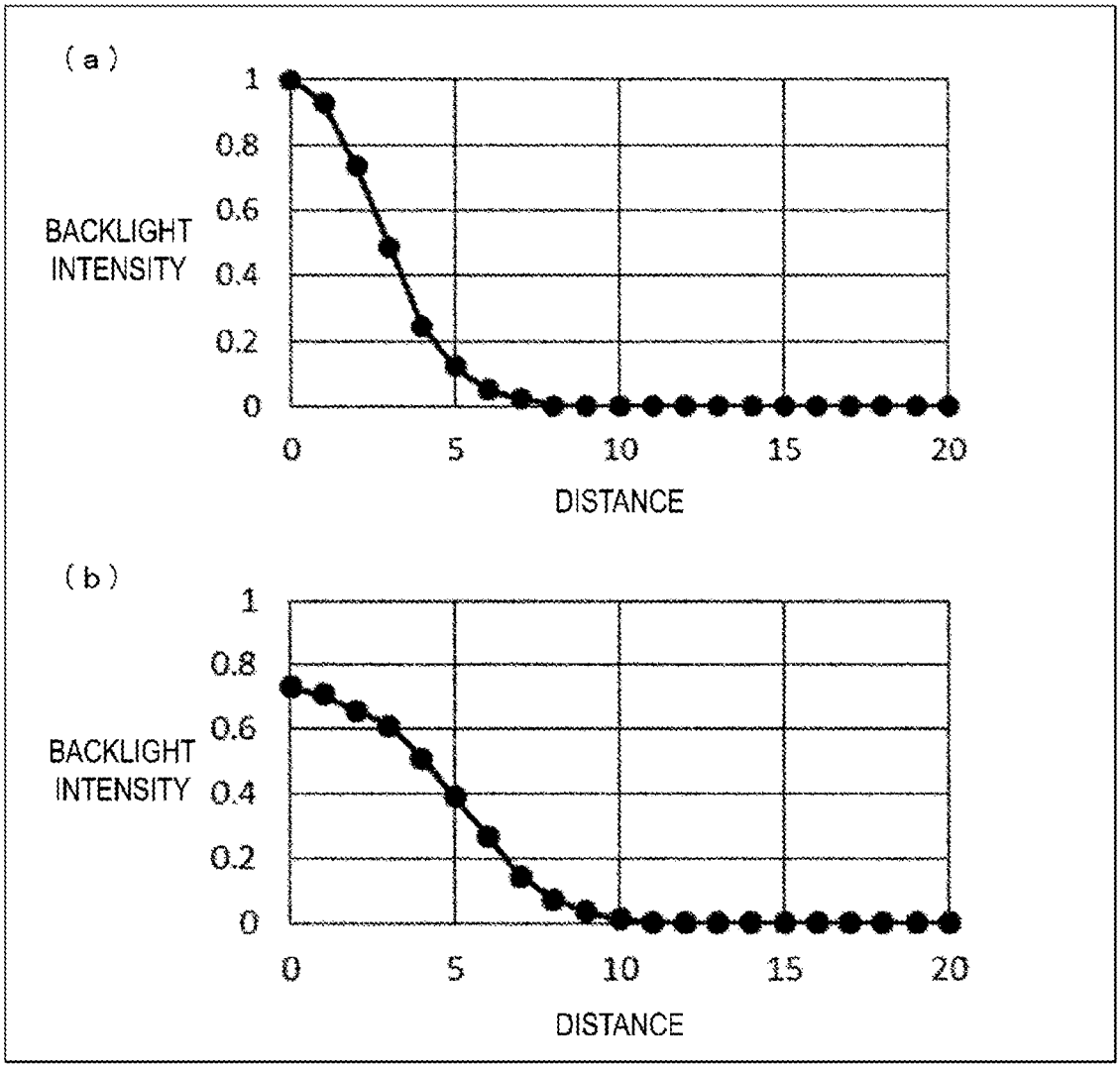
FIG. 11(*a*) is a graph showing an example of a first LUT, and FIG. 11(*b*) is a graph showing an example of a second LUT.

(a) of FIG. 11 is a graph showing an example of the first LUT. (b) of FIG. 11 is a graph showing an example of the second LUT. In (a) and (b) of FIG. 11, the horizontal axis represents a distance in the x-direction, and the vertical axis represents a value obtained by normalizing the intensity of illumination light by setting an upper limit value to 1. As shown in (a) and (b) of FIG. 11, the value of the first LUT is greater than the value of the second LUT in a range close to the central area C. On the other hand, the value of the first LUT decreases rapidly away from the central area C, while the value of the second LUT decreases gradually. The backlight luminance distribution calculation unit 12 calculates data1 and data2 with reference to the first LUT and the second LUT.

Subsequently, the backlight luminance distribution calculation unit 12 calculates the intensity of an illumination light from the control area R3 in the pixel of interest P by performing interpolation between the data1 and the data2 (SB6). For example, the backlight luminance distribution calculation unit 12 may calculate the intensity of illumination light in the pixel of interest P according to Equation (3) below. Note that Equation (3) is a formula for linear interpolation.

$$IB=\text{data2}+(\text{data1}-\text{data2})\times(n-1)/IMG_Y \quad (3)$$

IB: Illumination light intensity in the pixel of interest P n: The number of rows of the pixel of interest P viewed from the opposing portion 227

IMG_Y: An image size in the y-direction

Thereafter, the backlight luminance distribution calculation unit 12 executes the process of step SB7 and the subsequent processes illustrated in FIG. 9 by using the illumination light intensity calculated according to Equation (3).

Figure 12:
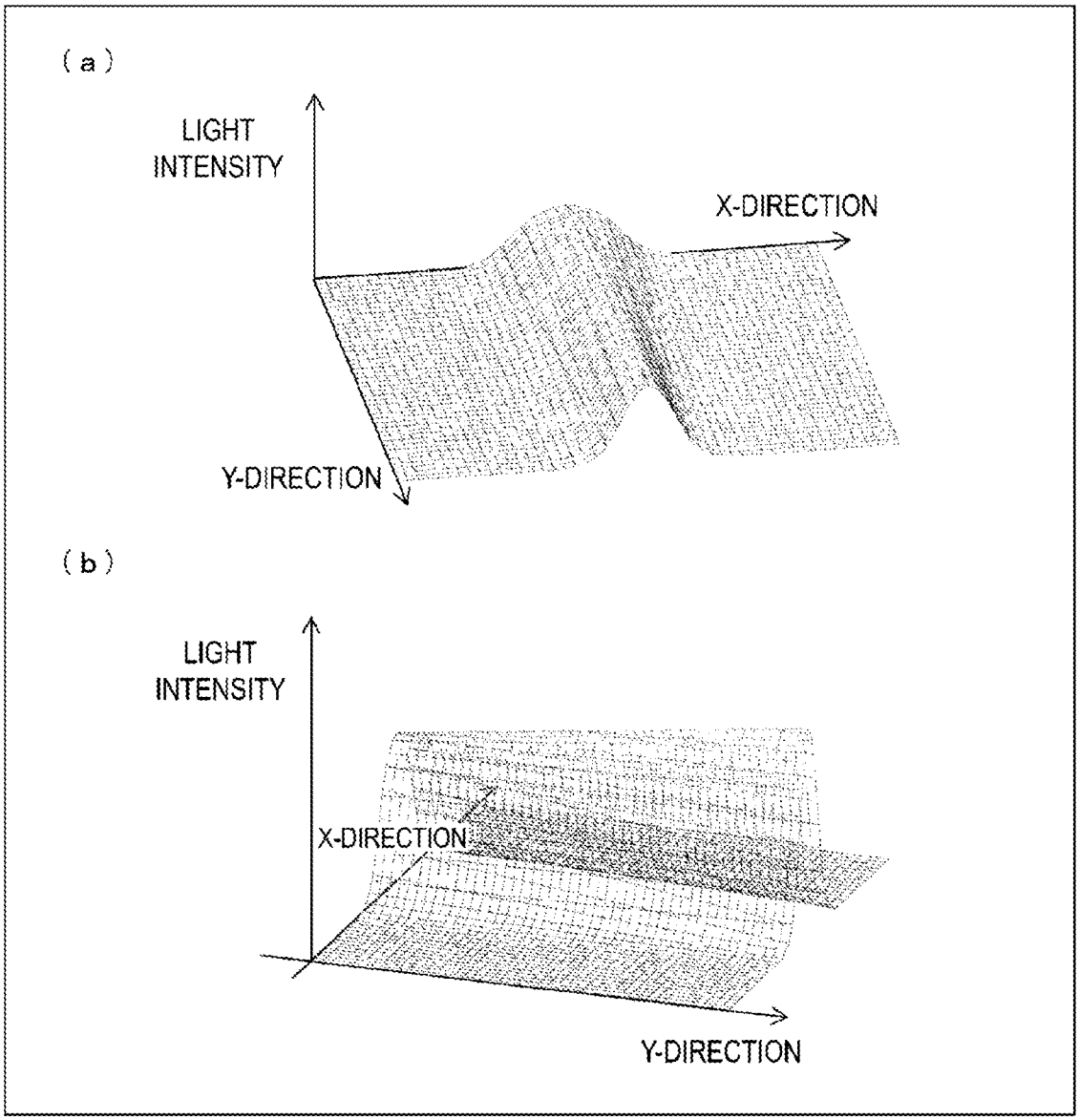
FIGS. 12(*a*) and 12(*b*) are diagrams illustrating an example of an illumination light intensity calculated by a backlight luminance distribution calculation unit according to the second embodiment.

(a) and (b) of FIG. 12 are diagrams illustrating an example of an illumination light intensity calculated by the backlight luminance distribution calculation unit 12 according to the present embodiment. Although scales differ between (a) and (b) of FIG. 12 for ease of viewing, these are the same graph viewed from different angles. Comparing (a) and (b) of FIG. 12 with (a) and (b) of FIG. 7, it can be understood that the backlight luminance distribution calculation unit 12 according to the present embodiment can reproduce attenuation of an illumination light intensity according to a distance from the light incident portion 226.

Third Embodiment

Another embodiment of the present disclosure will be described below. A liquid crystal display device according to the present embodiment has the same configuration as that of the liquid crystal display device 1 according to the first embodiment. Accordingly, in the following description, the liquid crystal display device according to the present embodiment is also referred to as the liquid crystal display device 1.

In the liquid crystal display device 1 according to the present embodiment, a first LUT (first one-dimensional lookup table) corresponds to a case where a pixel of interest is located closest to the light incident portion 226 or a case where the pixel of interest is closest to the opposing portion 227. Furthermore, a second LUT (second one-dimensional lookup table) corresponds to a case where a pixel of interest is located between the light incident portion 226 and the opposing portion 227. Specifically, the liquid crystal display device 1 according to the present embodiment holds three LUTs, that is, (i) an LUT corresponding to a case where the pixel of interest is located closest to the light incident portion 226, (ii) an LUT corresponding to a case where the pixel of interest is located closest to the opposing portion 227, and (iii) an LUT corresponding to a case where the pixel of interest is located between the light incident portion 226 and the opposing portion 227 (hereinafter, referred to as a third position).

The backlight luminance distribution calculation unit 12 calculates (i) an illumination light intensity in a case where the pixel of interest is located closest to the light incident portion 226, (ii) an illumination light intensity in a case where the pixel of interest is located closest to the opposing portion 227, and (iii) an illumination light intensity in a case where the pixel of interest is located at the third position, with reference to the three LUTs. Then, the backlight luminance distribution calculation unit 12 determines which one out of (i) the LUT corresponding to a case where the pixel of interest is located closest to the light incident portion 226 and (ii) the LUT corresponding to a case where the pixel of interest is located closest to the opposing portion 227 as a first LUT, in accordance with the position of the pixel of interest.

Specifically, in a case where the pixel of interest is located closer to the side of the light incident portion 226 than the third position, the backlight luminance distribution calculation unit 12 sets the LUT corresponding to a case where the pixel of interest is located closest to the light incident portion 226 to be the first LUT. On the other hand, in a case where the pixel of interest is located closer to the side of the opposing portion 227 than the third position, the backlight luminance distribution calculation unit 12 sets the LUT corresponding to a case where the pixel of interest is located closest to the opposing portion 227 to be the first LUT. Note that, in any case, the backlight luminance distribution calculation unit 12 sets the LUT corresponding to a case where the pixel of interest is located at the third position to be a second LUT.

The backlight luminance distribution calculation unit 12 may perform quadratic or higher spline interpolation by using three points of (i) the illumination light intensity in a case where the pixel of interest is located closest to the light incident portion 226, (ii) the illumination light intensity in a case where the pixel of interest is located closest to the opposing portion 227, and (iii) the illumination light intensity in a case where the pixel of interest is located at the third position.

Figure 13:
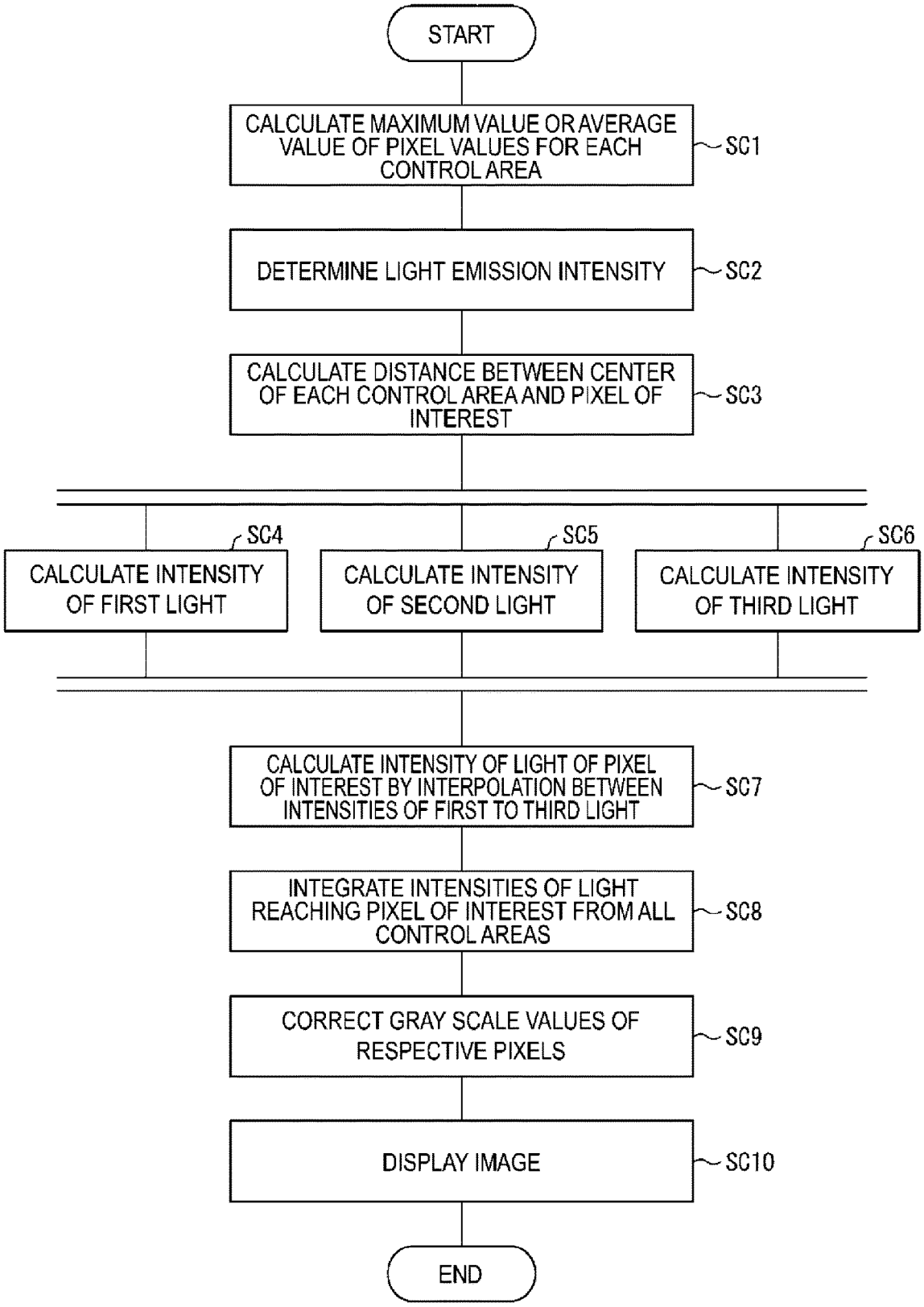
FIG. 13 is a flowchart illustrating an example of a flow of processing in a liquid crystal display device according to a third embodiment.

FIG. 13 is a flowchart illustrating an example of a flow of processing in the liquid crystal display device 1 according to the present embodiment. The processing in the liquid crystal display device 1 according to the present embodiment will be described with reference to FIG. 13. The processing includes a light intensity calculating method for calculating the intensity of illumination light emitted from the backlight 22 in a pixel of interest of the liquid crystal display device 1 which is performed by the backlight luminance distribution calculation unit 12.

The processes of steps SC1 to SC3 are the same as the above-described processes of steps SA1 to SA3, respectively. Next, the backlight luminance distribution calculation unit 12 calculates (i) the illumination light intensity in a case where the pixel of interest is located closest to the light incident portion 226 (first light intensity), (ii) the illumination light intensity in a case where the pixel of interest is located closest to the opposing portion 227, and (iii) the illumination light intensity in a case where the pixel of interest is located at the third position, which have been described above (SC4 to SC6). Steps SC4 to SC6 may be executed simultaneously as illustrated in FIG. 13 or may be executed in any order.

Furthermore, the backlight luminance distribution calculation unit 12 calculates the intensity of light of the pixel of interest by using the calculated three illumination light intensities (SC7). Thereafter, the liquid crystal display device 1 displays an image through the processes of steps SC8 to SC10. The processes of steps SC8 to SC10 are the same as the processes of steps SA6 to SA8 described above.

Specific Example

Figure 14:
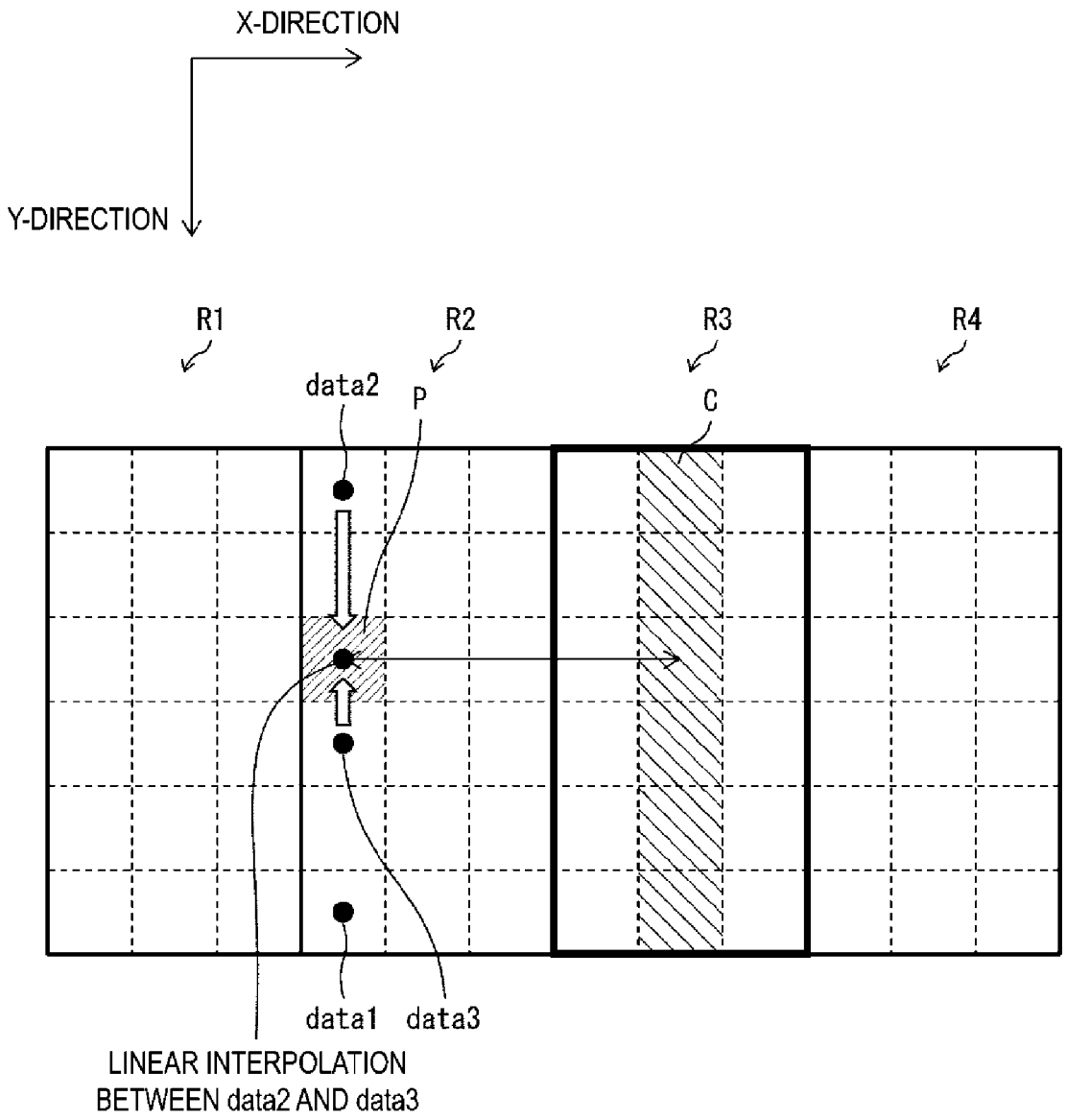
FIG. 14 is a diagram schematically illustrating processing in the liquid crystal display device according to the third embodiment.

FIG. 14 is a diagram schematically illustrating processing in the liquid crystal display device 1 according to the present embodiment. Referring to FIG. 14, a specific example of the processes of steps SC3 to SC7 described above in one pixel of interest P will be described. The position of the pixel of interest Pin FIG. 14 is the same as the position of the pixel of interest Pin FIGS. 4 and 10.

First, the backlight luminance distribution calculation unit 12 calculates that a distance between the pixel of interest P and a central area C of a control area R3 is 4 (SC3). Next, the backlight luminance distribution calculation unit 12 calculates data1 indicating an illumination light intensity in a pixel which has a distance from the central area C being equal to that of the pixel of interest P and which is closest to the light incident portion 226 (SC4). Similarly, the backlight luminance distribution calculation unit 12 calculates (i) data2 indicating an illumination light intensity in a pixel which has a distance from the central area C being equal to that of the pixel of interest P and which is closest to the opposing portion 227 and (ii) data3 indicating an illumination light intensity in a pixel which has a distance from the central area C being equal to that of the pixel of interest P and which is located at the above-described third position in the y-direction (SC5, SC6).

Figure 15:
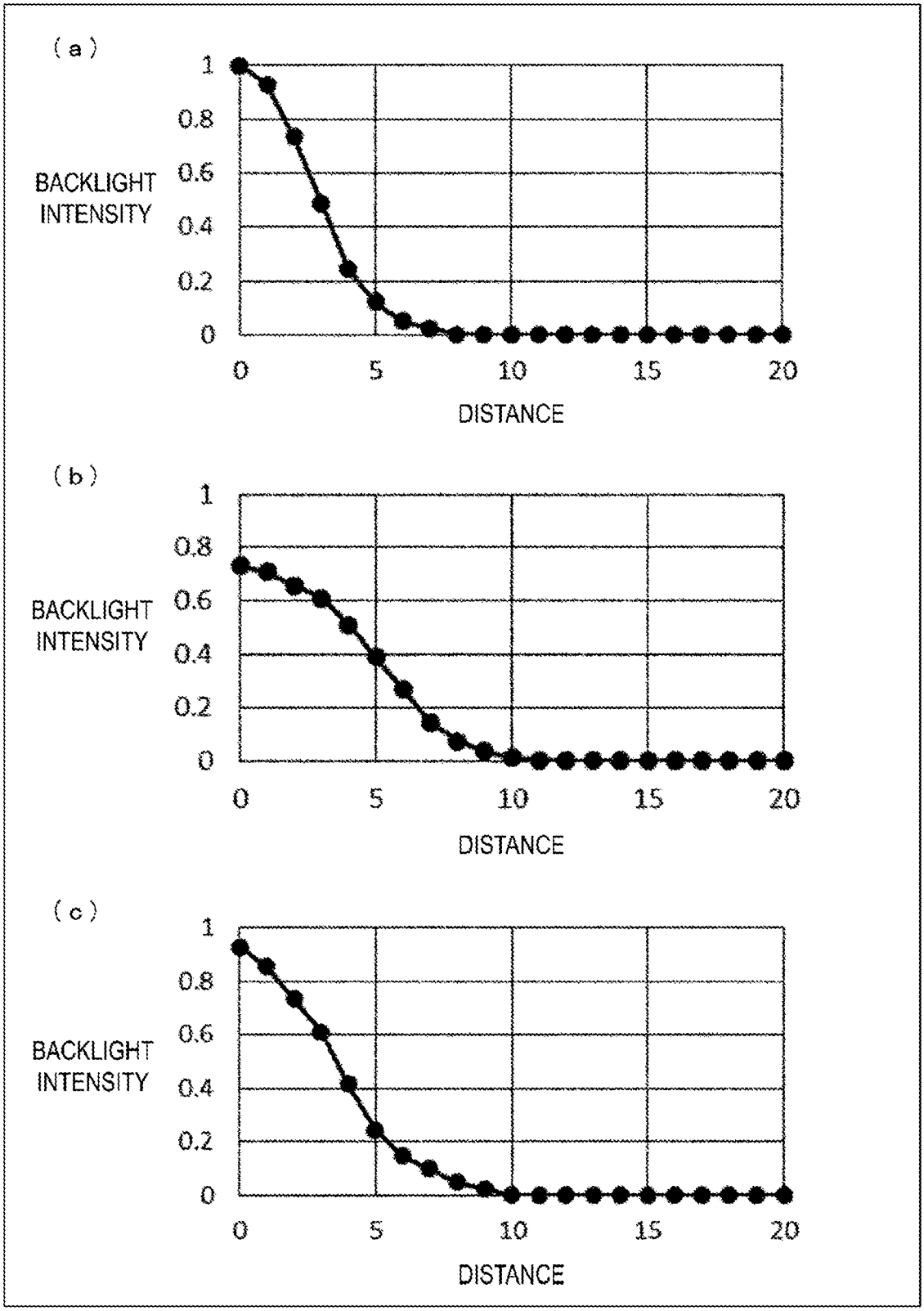
FIGS. 15(*a*) and 15(*b*) are graphs showing examples of a first LUT in the third embodiment, and FIG. 15(*c*) is a graph showing an example of a second LUT in the third embodiment.

(a) and (b) of FIG. 15 are graphs showing examples of the first LUT according to the present embodiment. (c) of FIG. 15 is a graph showing an example of the second LUT of the present embodiment. In (a) to (c) of FIG. 15, the horizontal axis represents a distance in the x-direction, and the vertical axis represents a value obtained by normalizing the intensity of illumination light by setting an upper limit value to 1.

As described above, the first LUT in the present embodiment corresponds to a case where a pixel of interest is located closest to the light incident portion 226 or a case where a pixel of interest is located closest to the opposing portion 227. For this reason, the first LUT in the present embodiment is any one of the first LUT and the second LUT in the second embodiment. Thus, (a) and (b) of FIG. 15 are the same as (a) and (b) of FIG. 11.

On the other hand, as described above, the second LUT in the present embodiment corresponds to a case where a pixel of interest is positioned between the light incident portion 226 and the opposing portion 227. For this reason, as illustrated in (c) of FIG. 15, in the second LUT in the present embodiment, both an initial value of an illumination light intensity and the speed of attenuation are between the LUTs illustrated in (a) and (b) of FIG. 15.

The backlight luminance distribution calculation unit 12 calculates data1 to data3 with reference to the LUTs illustrated in (a) to (c) of FIG. 15. Subsequently, the backlight luminance distribution calculation unit 12 calculates the intensity of an illumination light from the control area R3 at the pixel of interest P by using the data1 to the data3 (SC7).

To calculate the intensity of an illumination light from the control area R3 in the pixel of interest P, first, the backlight luminance distribution calculation unit 12 determines an illumination light intensity to be used for calculation of an illumination light intensity out of the data1 and the data2. In the example illustrated in FIG. 14, the pixel of interest P is located between the pixel of the data2 and the pixel of the data3. In this case, the backlight luminance distribution calculation unit 12 determines the data2 to be an illumination light intensity to be used for calculation of an illumination light intensity. Subsequently, the backlight luminance distribution calculation unit 12 calculates the intensity of the illumination light in the pixel of interest P by using the data2 and the data3. For example, the backlight luminance distribution calculation unit 12 may calculate the intensity of the illumination light in the pixel of interest P according to Equation (4) below.

$$IC=\text{data2}+(\text{data3}-\text{data2})\times(n-1)/m \quad (4)$$

IC: An illumination light intensity in the pixel of interest P n: The number of rows of the pixel of interest P viewed from the opposing portion 227 m: The number of rows of the pixel of the data3 viewed from the opposing portion 227

On the other hand, in a case where the pixel of interest P is located between the pixel of the data1 and the pixel of the data3, the backlight luminance distribution calculation unit 12 determines the data1 to be an illumination light intensity to be used for calculation of an illumination light intensity. Subsequently, the backlight luminance distribution calculation unit 12 calculates the intensity of illumination light in the pixel of interest P by using the data1 and the data3. For example, the backlight luminance distribution calculation unit 12 may calculate the intensity of illumination light in the pixel of interest P according to Equation (5) below.

$$IC=\text{data3}+(\text{data1}-\text{data3})\times(n-m)/(IMG_Y-m) \quad (5)$$

IC: An illumination light intensity in the pixel of interest P n: The number of rows of the pixel of interest P viewed from the opposing portion 227 m: The number of rows of the pixel of the data3 viewed from the opposing portion 227

IMG_Y: An image size in the y-direction

Thereafter, the backlight luminance distribution calculation unit 12 executes the process of step SC8 and the subsequent processes illustrated in FIG. 13 by using the illumination light intensity calculated according to Equation (4) or (5).

Figure 16:
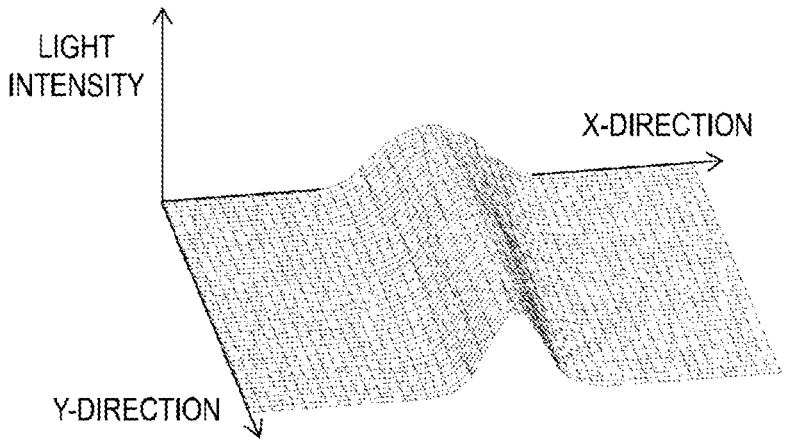
FIG. 16 is a diagram illustrating an example of an illumination light intensity calculated by a backlight luminance distribution calculation unit according to the third embodiment.

FIG. 16 is a diagram illustrating an example of an illumination light intensity calculated by the backlight luminance distribution calculation unit 12 according to the present embodiment. According to the backlight luminance distribution calculation unit 12 of the present embodiment, the intensity of illumination light can be more appropriately reproduced, as illustrated in FIG. 16. In addition, according to the backlight luminance distribution calculation unit 12 of the present embodiment, an illumination light intensity can be reproduced with high accuracy even in a case where the way of spreading of light and the degree of attenuation are not constant due to, for example, the characteristics of the light guide plate 225 and the like.

Note that, in an aspect of the present disclosure, the liquid crystal display device 1 may further include a LUT corresponding to a case where a pixel of interest is located between the light incident portion 226 and the opposing portion 227 at a position different from the third position described above. In this case, the backlight luminance distribution calculation unit 12 may calculate the intensity of illumination light in the pixel of interest by using the intensity of illumination light in two pixels located on both sides of the pixel of interest.

Example of Implementation with Software

Control blocks (in particular, the backlight light emission intensity determination unit 11, the backlight luminance distribution calculation unit 12, and the image data correction unit 13) of the liquid crystal display device 1 may be implemented by a logic circuit (hardware) formed in an integrated circuit (IC chip) or the like, or may be implemented by software.

In the latter case, the liquid crystal display device 1 includes a computer that executes an instruction of a program which is software for implementing each function. The computer includes, for example, at least one processor (control device) and includes at least one computer-readable recording medium storing the program. Further, in the computer, the processor reads and executes the program from the storage medium, whereby the object of the present disclosure is achieved. For example, a Central Processing Unit (CPU) can be used as the processor. In addition to a "non-transitory tangible medium", for example, a Read Only Memory (ROM) or the like, examples of the storage medium to be used may include a tape, a disk, a card, a semiconductor memory, and a programmable logic circuit. Furthermore, a Random Access Memory (RAM) in which the program is loaded may be further provided. Furthermore, the program may be supplied to the computer through any transmission medium that can transmit the program (a communication network, broadcast waves, or the like). Note that an aspect of the present disclosure can also be implemented in the form of data signals that are embedded in carrier waves, in which the program is implemented by electronic transmission.

The present disclosure is not limited to the embodiments described above, and various modifications may be made within the scope of the claims. Embodiments obtained by appropriately combining technical approaches disclosed in the different embodiments also fall within the technical scope of the present disclosure. Furthermore, novel technical features can be formed by combining the technical approaches disclosed in the embodiments.

Mutual Reference to Related Applications

The present application claims the benefit of priority with respect to JP 2018-154909 filed on Aug. 21, 2018, which is incorporated herein by reference in its entirety.

REFERENCE SIGNS LIST

1 Liquid crystal display device (display device)
12 Backlight luminance distribution calculation unit (calculation unit)
22 Backlight (illumination unit)
221 to 224 Light source
226 Light incident portion
227 Opposing portion
24 Display panel (display unit)
P Pixel of interest
R1 to R4 Control area (area)

The invention claimed is:

1. A display device comprising:

an illumination unit including a plurality of areas configured to emit light in response to light entering from a plurality of light sources configured to be independently controllable;

a display unit including a plurality of pixels configured to receive illumination light from the illumination unit; and a calculation unit configured to calculate an intensity of the illumination light in a pixel of interest, wherein the illumination unit includes a light incident portion which is an end portion on which light from the plurality of light sources is incident and an opposing portion which is an end portion on a side opposite to the light incident portion and is divided along a first direction from the light incident portion to the opposing portion to form the plurality of areas, and the calculation unit calculates a virtual distance obtained by correcting a distance between the pixel of interest and one of the plurality of areas on the basis of a distance between the pixel of interest and the light incident portion, and calculates an intensity of illumination light corresponding to the virtual distance that is calculated as an intensity of illumination light in the pixel of interest, with reference to a one-dimensional lookup table indicating a relationship between a distance from one of the plurality of areas and an intensity of illumination light at the distance.

2. A display device comprising:

an illumination unit including a plurality of areas configured to emit light in response to light entering from a plurality of light sources configured to be independently controllable;

a display unit including a plurality of pixels configured to receive illumination light from the illumination unit; and a calculation unit configured to calculate an intensity of the illumination light in a pixel of interest with reference to a one-dimensional lookup table of the pixel of interest, the one-dimensional lookup table indicating a relationship between a distance from one of the plurality of areas and an intensity of illumination light at the distance, wherein the illumination unit includes a light incident portion which is an end portion on which light from the plurality of light sources is incident and an opposing portion which is an end portion on a side opposite to the light incident portion and is divided along a first direction from the light incident portion to the opposing portion to form the plurality of areas, and the calculation unit calculates an intensity of illumination light in the pixel of interest with reference to a first one-dimensional lookup table corresponding to a case where the pixel of interest is located at a first position in a first direction and a second one-dimensional lookup table corresponding to a case where the pixel of interest is located at a second position in the first direction.

3. The display device according to claim 2, wherein the calculation unit calculates a first illumination light intensity corresponding to the distance determined with reference to the first one-dimensional lookup table and a second illumination light intensity corresponding to the distance determined with reference to the second one-dimensional lookup table, and calculates an intensity of illumination light in the pixel of interest on the basis of at least the first illumination light intensity, the second illumination light intensity, and a relative position of the pixel of interest in the first direction.

4. The display device according to claim 2, wherein the first one-dimensional lookup table corresponds to a case where the pixel of interest is located closest to the light incident portion, and the second one-dimensional lookup table corresponds to a case where the pixel of interest is located closest to the opposing portion.

5. The display device according to claim 2, wherein the first one-dimensional lookup table corresponds to a case where the pixel of interest is located closest to the light incident portion or a case where the pixel of interest is located closest to the opposing portion, and the second one-dimensional lookup table corresponds to a case where the pixel of interest is located between the light incident portion and the opposing portion.

6. The display device according to claim 1, wherein the calculation unit calculates an intensity of illumination light in the pixel of interest by integrating intensities of illumination light calculated for each of the plurality of areas.

7. A light intensity calculating method for calculating an intensity of illumination light from an illumination unit in a pixel of interest of a display device, the display device including an illumination unit including a plurality of areas configured to emit light in response to light entering from a plurality of light sources configured to be independently controllable and a display unit including a plurality of pixels configured to receive illumination light from the illumination unit, the illumination unit including a light incident portion which is an end portion on which light from the plurality of light sources is incident and an opposing portion which is an end portion on a side opposite to the light incident portion and being divided along a first direction from the light incident portion to the opposing portion to form the plurality of areas, the light intensity calculating method comprising:

calculating a virtual distance obtained by correcting a distance between the pixel of interest and one of the plurality of areas on the basis of a distance between the pixel of interest and the light incident portion; and calculating an intensity of illumination light in the pixel of interest with reference to a one-dimensional lookup table indicating a relationship between a distance from the area and an intensity of illumination light at the distance by using the virtual distance that is calculated.

8. A light intensity calculating method for calculating an intensity of illumination light from an illumination unit in a pixel of interest of a display device, the display device including an illumination unit including a plurality of areas configured to emit light in response to light entering from a plurality of light sources configured to be independently controllable and a display unit including a plurality of pixels configured to receive illumination light from the illumination unit, the illumination unit including a light incident portion which is an end portion on which light from the plurality of light sources is incident and an opposing portion which is an end portion on a side opposite to the light incident portion and being divided along a first direction from the light incident portion to the opposing portion to form the plurality of areas, the light intensity calculating method comprising:

calculating a first illumination light intensity corresponding to a distance from one of the plurality of areas with reference to a first one-dimensional lookup table of the pixel of interest which indicates a relationship between the distance and an intensity of illumination light at the distance, the first one-dimensional lookup table corresponding to a case where the pixel of interest is located at a first position in the first direction;

calculating a second illumination light intensity corresponding to the distance with reference to a second one-dimensional lookup table which is the one-dimensional lookup table and corresponds to a case where the pixel of interest is located at a second position in the first direction; and calculating an intensity of illumination light in the pixel of interest by using the first and second illumination light intensities that are calculated.

* * * * *